US005316501A

United States Patent [19]

Mair

[11] Patent Number: 5,316,501

[45] Date of Patent: May 31, 1994

[54] SHIELDED MULTIPOLAR CONNECTOR

[75] Inventor: Eduard Mair, München, Fed. Rep. of Germany

[73] Assignee: Siemens Aktiengesellschaft, Munich, Fed. Rep. of Germany

[21] Appl. No.: 50,036

[22] PCT Filed: Oct. 23, 1991

[86] PCT No.: PCT/DE91/00828

§ 371 Date: Apr. 29, 1993

§ 102(e) Date: Apr. 29, 1993

[87] PCT Pub. No.: WO92/08261

PCT Pub. Date: May 14, 1992

[30] Foreign Application Priority Data

Nov. 6, 1990 [DE] Fed. Rep. of Germany ... 9015255[U]

[51] Int. Cl.[5] ..... H01R 13/658

[52] U.S. Cl. ..... 439/607; 439/609; 439/108

[58] Field of Search ..... 439/101, 108, 607, 609, 439/608

[56] References Cited

U.S. PATENT DOCUMENTS

| | | | |
|---|---|---|---|
| 4,959,024 | 9/1990 | Czeschka | 439/607 |
| 5,066,236 | 11/1991 | Broeksteeg | 439/108 |
| 5,080,597 | 1/1992 | Seidel et al. | 439/108 |
| 5,104,329 | 4/1992 | Brown et al. | 439/609 |
| 5,104,341 | 4/1992 | Gilissen et al. | 439/608 |
| 5,130,896 | 7/1992 | Babb et al. | 439/607 |
| 5,141,445 | 8/1992 | Little | 439/607 |
| 5,160,272 | 11/1992 | Zell et al. | 439/607 |

FOREIGN PATENT DOCUMENTS

| | | |
|---|---|---|
| 0340570 | 11/1989 | European Pat. Off. . |
| 0412331 | 2/1991 | European Pat. Off. . |

*Primary Examiner*—Gary F. Paumen

*Attorney, Agent, or Firm*—Hill, Steadman & Simpson

[57] ABSTRACT

A multipole plug connector (1) having connecting elements (10) on the rear side for incoming leads is completely surrounded by a shielding plate (3), with the exception of its insertion side. The shielding plate (3) is composed of material which is in the form of a strip and is bent around the plug connector, and whose ends overlap such that they make contact. In consequence, a particularly good shielding effect is achieved.

8 Claims, 2 Drawing Sheets

SHIELDED MULTIPOLAR CONNECTOR

BACKGROUND OF THE INVENTION

The present invention relates to a multipole plug connector having plug contact elements and connecting elements on the rear side for incoming leads, the plug connector and the connecting elements being surrounded by an earthed shielding jacket, with the exception of the insertion side.

It is known for such plug connectors to be sheathed with shell-like housing halves composed of deep-drawn sheet metal. In this case, it is normal to connect the shielding jacket to earth potential.

It is furthermore known, for example from the German Utility Pattern Patent 8,911,590 (corresponding to European Patent reference 0,412,331 Al) to arrange separate shielding plates on both sides of the printed-circuit board and of a plug body in the case of a plug connector which is placed on a printed-circuit board, the rear sides of which shielding plates are bent towards the printed-circuit board and are provided with stamped-free insertion pins which are pressed into solder eyes in the printed-circuit board. Feathered ground plates are placed on contact pins on the rear wall of the assembly, which ground plates have a bulge which extends in their longitudinal direction and in whose region lateral slots are arranged. These bulges catch the shielding plate of the plug-on plug connector, subject to spring tension.

SUMMARY OF THE INVENTION

The invention is based on the object of achieving a maximum shielding effect using a shielding jacket which can be produced cost-effectively.

This object is achieved by means of a multipole plug connector having plug contact elements and connecting elements on the rear side for incoming leads. The plug connector and the connecting elements are surrounded by a shielding jacket, with the exception of the insertion side. The shielding jacket is produced from at least one feathered shielding plate which is in the form of a strip, is provided with lateral slots and is bent around the plug connector and the connecting elements in an overlapping manner. The overlapping ends of the shielding plate are connected to one another such that they make contact. In the region of the lateral slots, corresponding bending edges of the shielding plates lie along the side edges of the plug connector extending in the insertion direction. The shielding jacket can now be produced cost-effectively, from a shielding plate strip which is supplied as strip material. The strip is cut to size such that not only the longitudinal side and the rear side but also the ends of the plug connector are surrounded. At the same time, care must be taken to ensure that the ends of the shielding plate overlap so that they can make contact with one another. Since the shielding plate is now constructed to be sprung in its feathered region, it requires no mating plates which are held on the assembly rear wall. The shielding plate can thus make direct contact with the contact pins on the rear wall, in a sprung manner. In this case, care must be taken to ensure that the bends in the shielding plate lie along the side edges of the plug connector in the region of the lateral slots, so that, despite the bulges, the shielding plate can be bent smoothly around the side edges. The plug connector is shielded to a maximum extent by the overlaps and by the fact that they make contact.

Advantageous developments of the present invention are as follows.

The development, wherein the shielding plate has overlapping regions on the rear side of the plug connector, facing away from the insertion side, prevents gaps, which would have an adverse effect on the shielding effect, being produced in the region of the rearward side edges of the shielding plate.

The development, wherein in the extended state, the shielding plate is provided with a bulge, which extends in the longitudinal direction of the shielding plate and has a large number of lateral slots whose pitch is equal to the pitch of the contact springs, makes it possible for in each case one spring tongue of the shielding plate to make contact with a grounded contact pin on the assembly rear wall. This results in a maximum number of contact points, which improve the shielding effect.

The development, wherein the incoming leads are constructed in a printed-circuit board which extends in the insertion direction and is mechanically and electrically connected to the plug connector and whose outer metallized layers are constructed as ground potential layers, makes it possible to use the shielded plug connector both as a cable plug and as an assembly plug, in the case of which the incoming leads are located between the outer shielding layers and are thus optimally shielded.

The development, wherein the printed-circuit board overhangs the plug connector at the rear and end with the shielding plate having a recess for the printed-circuit board and making contact with the ground potential layers of the printed-circuit board, makes it possible for the ground, potential layers of the printed-circuit board to make direct contact with the edges of the shielding plate which bound the recess, for example by soldering. The two-piece shielding plate, wherein the shielding plate has two cap-like sub-plates which are placed on the plug connector on both sides of the printed-circuit board and whose ends at least partially overlap and make contact with one another, preferably by means of laser welding, with insertion pins, which are stamped free along the side edges of the shielding plate, that project into the recess from the printed-circuit board, can be mechanically and electrically connected to the printed-circuit board in a cost-effective manner, by pressing into the solder eyes. In this case, care must once again be taken to ensure that the ends of the two sub-plates overlap and make contact with one another by means of laser welding, which improves the shielding effect. Making contact by laser welding can be carried out without any problems once the sub-plates have been positioned.

The development, wherein the rear sides of the two sub-plates are offset by the pitch of the printed-circuit board hole grid, results in each case one complete row of holes on the printed-circuit board being available for the rear sides of both sub-plates, which makes possible an adequate number of contacts, with a maximum shielding effect.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENT

Figure 1:
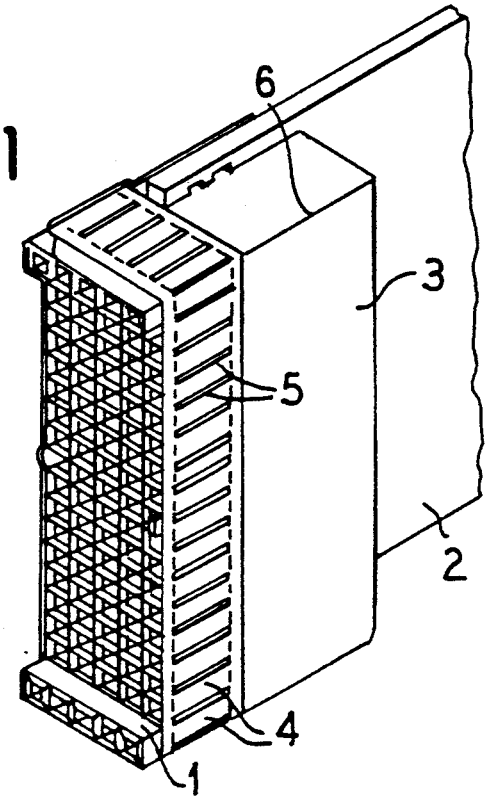
FIG. 1 shows a perspective view of a multipole plug connector having a printed-circuit board and a shielding jacket.
Figure 2:
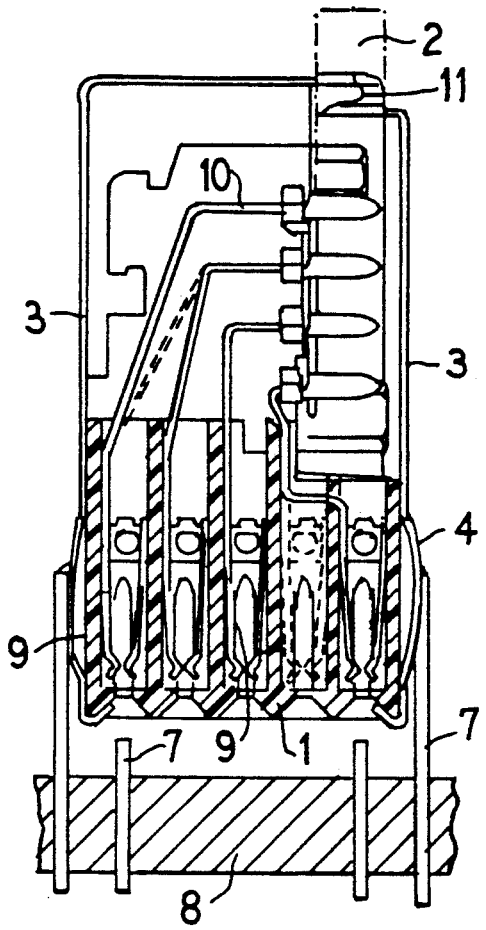
FIG. 2 shows a cross section through the plug connector according to FIG. 1.

In FIG. 1, a multipole plug connector 1 is placed on a printed-circuit board 2 to which, for example, one or more cables can be connected. The printed-circuit board is kept so wide that it overhangs the narrow ends of the oblong plug connector 1. The plug connector has a two-piece, feathered shielding plate 3, which largely encloses the plug connector 1 with the exception of its insertion side. The shielding plate 3 is produced from strip material which is provided with a bulge which extends in its longitudinal direction. The bulge is provided with a large number of closed lateral slots 5 between which the shielding plate forms contact tongues 4, which are like plate springs and extend essentially in the insertion direction. The contact tongues 4 are located in the vicinity of the insertion side of the plug connector 1. The shielding plate 3 is bent around the plug connector 1 and its connecting element such that the narrow ends are also shielded. In this case, care must be taken to ensure that the bending edges 6, which extend in the insertion direction, lie along the side edges of the plug connector 1 in the region of in each case one of the lateral slots 5. In consequence, the bulge in the shielding plate is not affected by the bend, so that the bending process can be carried out without any problems. The shielding plate 3 is interrupted only by a recess for the laterally overhanging printed-circuit board 2. The resulting gap can be closed, for example, by the outer layers of the printed-circuit board 2 being constructed as ground potential layers with which the shielding plate 3 makes contact. In FIG. 2, the plug connector 1 is plugged onto contact pins 7 of a rear-wall wiring board 8. The contact tongues 4 are at the same level as the contact springs 9 of the plug connector 1 and make contact with adjacent, grounded contact pins 7 on the rear-wall wiring board 8. It can be seen that the shielding plate 3 encloses not only the plug body but also the rear connecting elements 10 of the plug connector 1. The connecting elements 10 make contact with the incoming leads of the printed-circuit board 2, which are not shown.

The sections of the shielding plate 3 which are bent towards the printed-circuit board are provided along their edges with projecting stamped-free insertion pins 11 which extend at right angles to the printed-circuit board 2. In order to be able to insert said pins 11 into the printed-circuit board 2, the shielding plate is composed of two shell-like halves which are positioned on the printed-circuit board 2 from both sides, the insertion pins 11 being pressed into corresponding solder eyes in the printed-circuit board.

Figure 3:
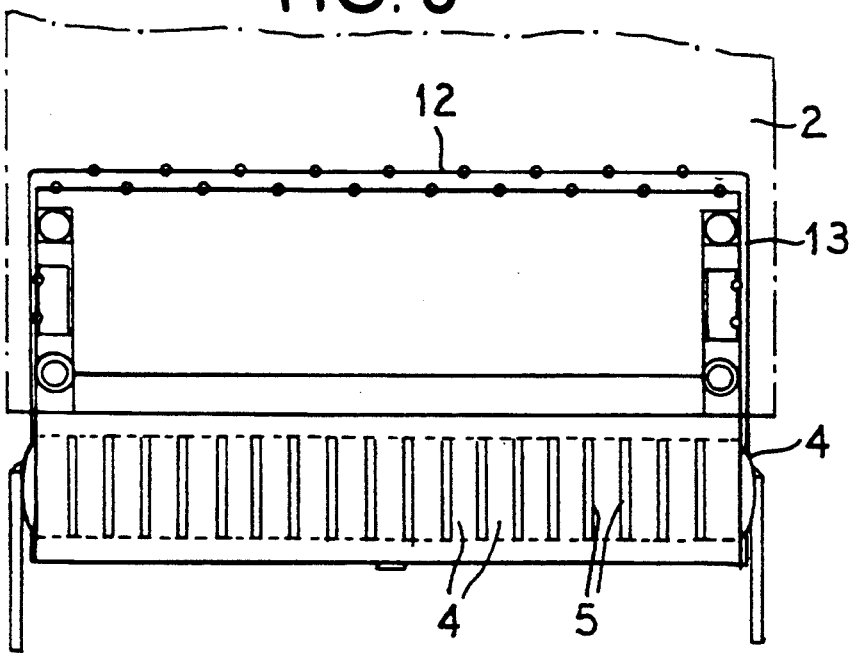
FIG. 3 shows a partially cut away side view of the plug connector, with the shielding plate as in FIG. 2.
Figure 4:
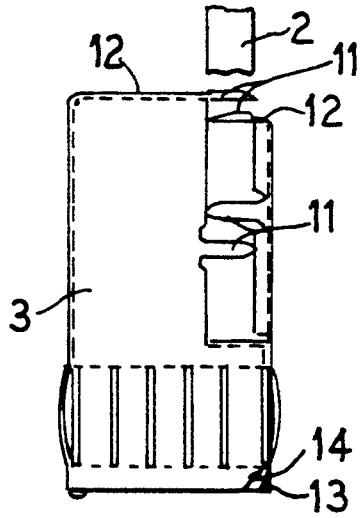
FIG. 4 shows an end view of the plug connector as in FIG. 3.
Figure 5:
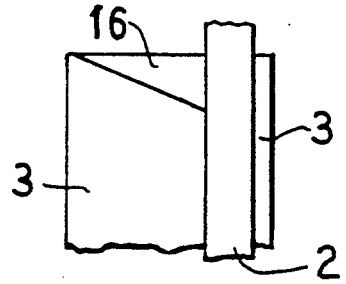
FIG. 5 shows a partial plan view of the plug connector, with the shielding plate as in FIG. 4.

In FIGS. 3, 4 and 5, the rear sides 12 of the two shielding plate parts are offset with respect to one another by the pitch of the hole grid of the printed-circuit board 2. This results in a full row of holes being available on the printed-circuit board 2, for the insertion pins 11, for both rear sides 12. The shielding effect is further improved as a result of the large number of contacts. Insertion pins 11 are also provided on the ends 13, which insertion pins 11 are pressed into corresponding solder eyes in the overhanging printed-circuit board 2. The two sub-plates are cut to size such that an overlap 14 is produced at the ends, in the region of which overlap 14 there is a laser spot weld 15 by means of which the two sub-plates make contact with one another. On the rear side 12, the shielding plate 3 has a further overlapping region 16 which is produced by cutting the corresponding shielding plate part to size in a suitable manner.

The invention is not limited to the particular details of the apparatus depicted and other modifications and applications are contemplated. Certain other change may be made in the above described apparatus without departing from the true spirit and scope of the invention herein involved. It is intended, therefore, that the subject matter in the above depiction shall be interpreted as illustrative and not in a limiting sense.

What is claimed is:

1. A multipole plug connector comprising plug contact elements and connecting elements on a rear side of the plug connector for incoming leads, the plug connector and the connecting elements being surrounded by a shielding jacket, with the exception of an insertion side of the plug connector, the shielding jacket being produced from at least one feathered shielding plate which is in the form of a strip, is provided with lateral slots and is bent around the plug connector and the connecting elements in an overlapping manner; overlapping ends of the shielding plate making contact with one another; and, in the region of the lateral slots, corresponding bending edges of the shielding plate lie along a respective side edge of the plug connector extending in an insertion direction.

2. The plug connector as claimed in claim 1, wherein the shielding plate has overlapping regions on a rear side of the plug connector, facing away from the insertion side.

3. The plug connector as claimed in claim 1, wherein the shielding plate is provided with a bulge, which extends in a longitudinal direction of said shielding plate and has a large number of said lateral slots whose pitch is equal to the pitch of contact springs.

4. The plug connector as claimed in claim 1, wherein a printed-circuit board extends in the insertion direction and is mechanically and electrically connected to the plug connector, the printed-circuit board having outer metallized layers that are ground potential layers.

5. The plug connector as claimed in claim 4, wherein the printed-circuit board overhangs the plug connector at a rear end of the plug connector, wherein the shielding plate has a recess for the printed-circuit board, and wherein the shielding plate makes contact with the ground potential layers of the printed-circuit board.

6. The plug connector as claimed in claim 4, wherein the shielding plate has two cap-like sub-plates which are placed on the plug connector on both sides of the printed-circuit board and whose ends at least partially overlap and make contact with one another, and wherein insertion pins, which are stamped free along the side edges of the shielding plate, project into the recess for the printed-circuit board.

7. The plug connector as claimed in claim 6, wherein rear sides of the two sub-plates are offset by a pitch of a hole grid of the printed-circuit board.

8. The plug connector as claimed in claim 6, wherein respective ends of said two cap-like sub-plates make contact with one another by being laser welded.

* * * * *